US005735523A

United States Patent [19]

Fioriglio

[11] Patent Number: 5,735,523

[45] Date of Patent: Apr. 7, 1998

[54] METHOD OF PLAYING A MODIFIED CHESS GAME

[76] Inventor: Patrick D. C. Fioriglio, 43 Bay 41st St., Brooklyn, N.Y. 11214

[21] Appl. No.: 762,766

[22] Filed: Dec. 10, 1996

[51] Int. Cl.[6] ..... A61F 3/02

[52] U.S. Cl. ..... 273/261; 273/260; D21/24

[58] Field of Search ..... 273/260, 261; D21/24

[56] References Cited

FOREIGN PATENT DOCUMENTS

| | | | |
|---|---|---|---|
| 386445 | 12/1923 | Germany | 273/260 |
| 98815 | 6/1923 | Switzerland | 273/260 |

OTHER PUBLICATIONS

"A Short History Of Chess", A. Davidson, McKay Publishing, pp. 104–107, Dec. 1981.

"New Rules For Classic Games", R. Wayne Schmittberger, John Wiley & Sons, Inc., pp. 204–206, Dec. 1992.

*Primary Examiner*—Benjamin H. Layno

[57] ABSTRACT

A modified chess game (10) consists of a game board (26) having eight horizontal rows and two additional columns added between the bishop and knight. A new game piece, an earl, is added and located on bottom and top row in each new columns. The earl moves in moves from an origin, along a left earl first movement for two forward diagonals then moves one forward diagonal perpendicular to the left earl first movement first direction along a left earl first movement second direction. An alternative move is disclosed consisting of a move along a left earl second movement one forward diagonal then moves two forward diagonals perpendicular to a left earl second movement second direction. The left earl (12AA) captures an opponent's game piece if the opponent game piece is on a square which is the terminating square of the left earl first movement or left earl second movement. Intervening game pieces of either side are jumped. At the next turn for the left earl (12AA) the move sequence may be repeated. When an opponent game piece is located on the next successive forward diagonal, the left earl (12AA) may move along a left earl third movement, one forward diagonal and capture the opponent game piece. A right earl (12AB) moves in a similar fashion. Four additional pawns are added complementary to the left earl (12AA) and right earl (12AB).

5 Claims, 2 Drawing Sheets

METHOD OF PLAYING A MODIFIED CHESS GAME

BACKGROUND OF THE INVENTION

1. Field of the Invention

The present invention relates to board games. More particularly, the present invention relates to the board game of chess having an unique playing piece added.

2. Description of the Prior Art

The standard game of chess is well known and played world wide. All of the potential moves have been documented and given time one can find the best counter move for any scenario presented by an opponent. The moves and counter moves are so well known that computers have been patented that can play the game against humans or against another computer. Many players study these materials and find that the excitement of the game is somewhat dulled.

The standard game of chess is played on a square game board divided into an eight by eight grid of squares alternately colored, typically white and black or red and black. Two sets of games pieces are arranged on opposite sides of the game board. The 'high value' pieced are arranged on the row furthest from the opponent. The lowest value piece, the pawn, is arranged in row directly in front of the latter. The objective is to place the opponents king in a condition which is formed by positioning the high value pieces such that the opponents king cannot move with out violating the high value pieces territory.

A need exists to expand upon the basic proven game of chess to provide more of a challenge to the players. This is easily accomplished by the addition of two additional games pieces and expanding the game board to accommodate the additional game pieces. When this expanded game is provided, the complexity and number of moves increases providing a more complex game to the individual.

Numerous innovations for Modified Chess Game have been provided in the prior art that are described as follows. Even though these innovations may be suitable for the specific individual purposes to which they address, they differ from the present invention as hereinafter contrasted.

In U.S. Pat. No. 5,536,014, titled Modified Chess Game, invented by Andras Serfozo, a technique for playing a modified chess game on a modified board, having a foremost playing area of eight square by eight square rows and plurality of marks printed on top of the board. The board possesses alternately colored red and white squares comprising a plurality of strategically placed green diamonds. The game having two sets of conventional chess pieces, differentiated by color. Each set comprising of 16 pieces, one set red the other white. The pieces are set up and move in a traditional chess manner. In addition when any royalty step on one of the squares marked with green diamond the player has to convert the royalties traditional movement to a specified move. As for the Queen and Knights the specified move is a single move, while for the King, Bishops, and Rooks is plural. In the case of a plurality the decision are always optional to the players. The object of the game is to position your pieces so your next move would capture the opponent's King and your opponent cannot move the King or any other pieces to protect the King or capture your piece. This is called checkmate.

The patented invention differs from the present invention because the patented invention is similar to chess with a modified game board having special zone which transform the pieces. The present invention differs because though it is a board game similar to chess with the basic: chess pieces, it has a modified method of play, the field of games pieces is extended by the addition of a duke and a pawn to each side and the game board is extended by the addition of two squares to each row.

In U.S. Pat. No. 5,421,582, titled Expanded Chess Game and Method Therefor, invented by Carl E. Ritter, a new, expanded chess game is disclosed which provides a game board having an upper surface for playing the expanded chess game and a first and a second set of game pieces for use by a first and a second player, respectively. The playing surface provides an unique octagonal shape comprised of a plurality of squares over which the game pieces move. Each set of game pieces includes the standard set of chess pieces from the standard game of chess, namely a King, a Queen, two Rooks, two Bishops, two Knights, and eight Pawns, and two of a new, separate game piece called the Viceroy. Each of the standard chess pieces operate in accordance with the rules of standard chess with the exception that the castling procedure is not permitted in the expanded chess game. The new, Viceroy game pieces move two spaces at a time in one of a forward, backward, left, right, or diagonal motion. The combination of the new, expanded octagonal playing surface with the new Viceroy game piece provides a new, expanded chess game having a greater number of potential game scenarios.

The patented invention differs from the present invention because the patented invention is similar to chess with an octagonal game board, and the addition of a new game piece, Viceroy. The Viceroy game pieces move two spaces at a time in one of a forward, backward, left, right, or diagonal motion. The present invention differs because though it is a board game similar to chess with the basic chess pieces, it has a modified method of play, the field of games pieces is extended by the addition of a duke and a pawn to each side and the game board remains rectangular but is extended by the addition of two squares to each row.

In U.S. Pat. No. 4,229,008, titled Board Games for Playing Draughts and Chess, invented by Michael J. Jameson, apparatus for playing a game which apparatus comprises a playing surface having marked thereon a plurality of unit areas aligned in three intersecting mutually inclined sets of parallel lines to form a triangular lattice array with the unit areas being spaced apart from each other, in which a first set of unit areas constituted by unit areas separated from each other by two unit areas in each of said lines is distinguished from the remaining unit areas, and at least two distinguishable sets of playing pieces each adapted to be moved over the playing surface from one unit area to another.

The patented invention differs from the present invention because the patented invention is game board having marked thereon a plurality of circular game piece spaces aligned in three intersecting mutually inclined sets of parallel rows. The game pieces are identical but have characteristic to distinguish opponents. The present invention is a board game, similar to chess with the basic chess pieces and method of play, widened by two squares to accommodate two new pieces. In the present invention the field of games pieces is extended by the addition of a duke and a pawn to each side. The duke's specific movement pattern is two diagonal spaces followed by one diagonal space. The duke may jump intervening pieces. The pawn is a standard pawn.

In U.S. Pat. No. 4,052,069, titled Board Game Apparatus, invented by Shamir Singh Sandhu, a game of skill between two opponents uses a playing board having a playing field divided into one hundred squares arranged in rows, columns and diagonals in which two sets of twenty-two laying pieces each are moved along the squares in row, column and diagonal directions, and with individual pieces of a distinctive shape, each for moving in a particular manner on the game board apparatus to capture the opponent's pieces. An extra row of squares or "cells" is provided for each of the two opponents on which are indicia indicating the position and placement of captured pieces which are freed by Sapahis (soldiers of the Maharaja) reaching the opposite side of the board.

The patented invention differs from the present invention because the patented invention is game board divided into one hundred squares arranged in rows, columns and diagonals. Two sets of twenty-two laying pieces each are moved along the squares in row, column and diagonal directions, and with individual pieces of a distinctive shape. Each game piece has specific scenarios for moving in a particular manner on the game board and capturing the opponent's pieces. The game pieces are identical but have charactered to distinguish opponents. The present invention is a board game similar to chess with the basic chess pieces and method of play. In the present invention the field of games pieces is extended by the addition of a duke and a pawn to each side. The duke's specific movement pattern is two diagonal spaces followed by one diagonal space. The duke may jump intervening pieces. The pawn is a standard pawn. The game board is widened by two squares to accommodate the new pieces.

Numerous innovations for Modified Chess Game have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a highly intellectual game played by two players. The game consists of a standard set of chess game pieces controlled by standard chess rules, with a new type of piece added to the back row. To accommodate the new piece the standard chess game board is made wider by two columns and complementary pawns are added. The present invention is a clever adaptation of the standard rules of chess in conjunction with new novel rules for controlling the new game piece.

The types of problems encountered in the prior art are that entire new games are disclosed with new rules and game pieces.

In the prior art, unsuccessful attempts to solve this problem were attempted namely: creating a new game. However, the problem was solved by the present invention because the standard game of chess is modified by the addition of one game piece keeping the balance of the rules and game pieces the same.

The present invention solved a long felt need for a new level of complexity to challenge the advanced chess players.

The present invention produced unexpected results namely a new and interesting adaptation of an well established game that is easy to learn yet is complex enough the challenge advanced minds.

Accordingly, it is an object of the present invention to provide a more interesting game with the addition of a single game piece and two additional columns to the game board.

More particularly, it is an object of the present invention to provide increased complexity with the addition of a game piece which moves along diagonals, and has a secondary move for capturing the opponents game pieces.

In keeping with these objects, and with others which will become apparent hereinafter, one feature of the present invention resides, briefly stated, in a new game piece, the earl, functioning to be moved along the diagonals. Two earls per side are provided and complementary pawns are added.

When the modified chess game is designed in accordance with the present invention, four pieces and two additional columns are added to the game increasing the complexity.

In accordance with another feature of the present invention, four additional pawns are added.

Another feature of the present invention is that the opponent may be attached along the diagonals with a new and novel move.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—modified chess game (10)

12AA—left earl (12AA)
left earl first movement (not shown)
left earl first movement first direction (not shown)
left earl first movement second direction (not shown)

left earl second movement (not shown)
left earl second movement first direction (not shown)
left earl second movement second direction (not shown)

left earl third movement (not shown)

12AB—right earl (12AB)
right earl first movement (not shown)
right earl first movement first direction (not shown)
right earl first movement second direction (not shown)

right earl second movement (not shown)
right earl second movement first direction (not shown)
right earl second movement second direction (not shown)
right earl third movement (not shown)

14A—left rook (14A)
14B—right rook (14B)

16A—left knight (16A)
16B—right knight (16B)

18A—left bishop (18A)
18B—right bishop (18B)

20A—left queen (20A)
20B—right queen (20B)

22A—left king (22A)
22B—right king (22B)

24A—left pawn (24A)
24B—right pawn (24B)

26—game board (26)

BRIEF DESCRIPTION OF THE PREFERRED EMBODIMENT

DETAILED DESCRIPTION OF THE PREFERRED EMBODIMENT

Figure 1:
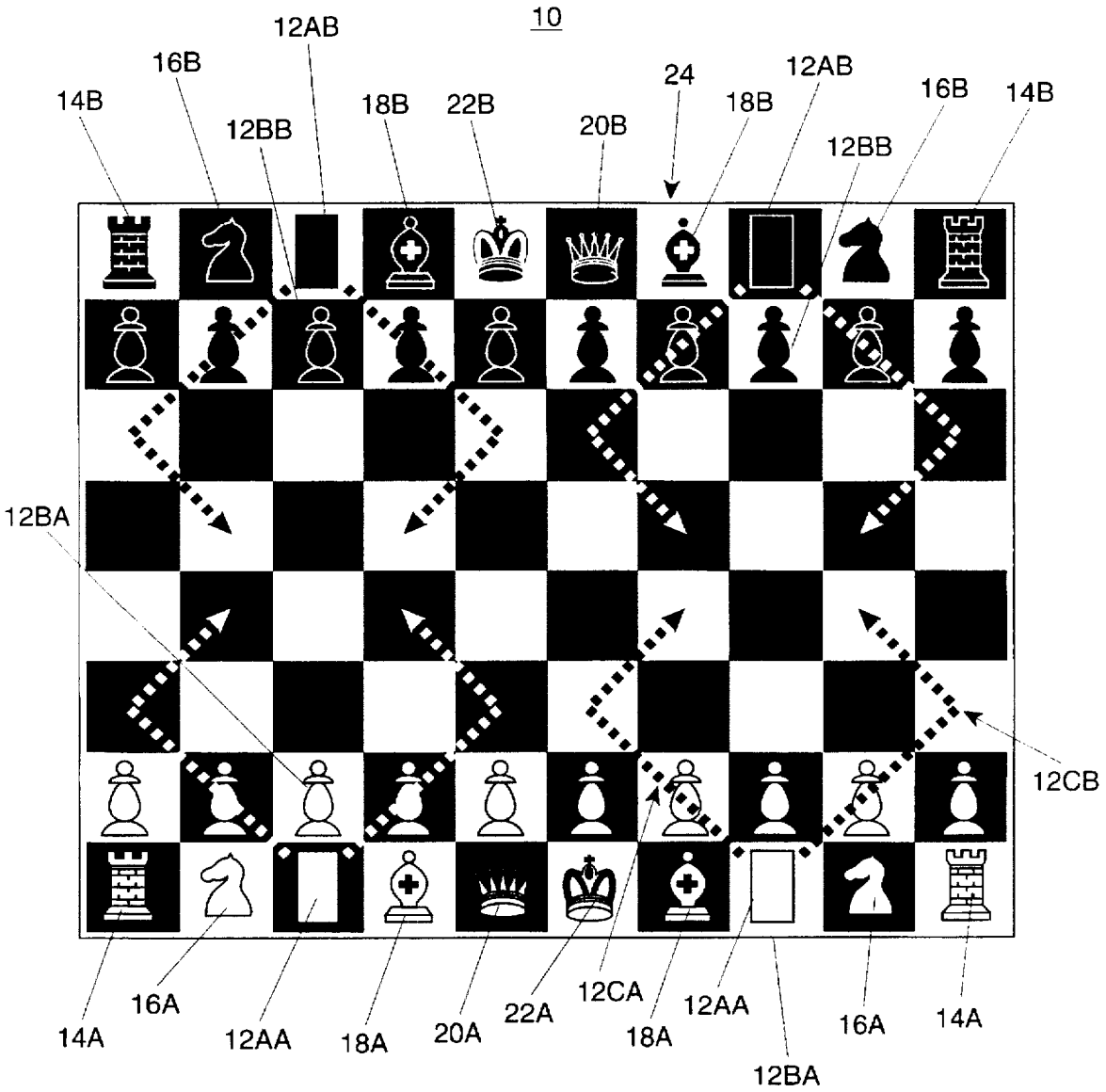
FIG. 1 is a top view of a modified chess game (10) showing the old and new pieces.

Firstly, referring to FIG. 1 which is a top view of a modified chess game (10) showing the old and new pieces having the following features: left earl (12AA), left earl first movement (not shown), left earl first movement first direction (not shown), left earl first movement second direction (not shown), right earl (12AB), right earl first movement (not shown), right earl first movement first direction (not shown), right earl first movement second direction (not shown), left rook (14A), right rook (14B), left knight (16A), right knight (16B), left bishop (18A), right bishop (18B), left queen (20A), right queen (20B), left king (22A), right king (22B), first left pawn (24A), right pawn (24B), and game board (26).

A modified chess game (10) comprises a game board (26) divided into squares formed by the intersections of eight rows and ten columns. The squares are alternately colored. The columns are labeled from left to right starting with A through J. The rows are labeled from bottom to top starting with 1 through 8.

Standard chess pieces are placed on the game board (26) with a column skipped between the standard placement of the Knights and Bishops on their respective rows. A pair of new pieces, a left earls (12AA) and a right earls (12AB) are added at the open spaces in the bottom and top rows. Additionally a left pawns (24A) and a right pawns (24B) are added to the empty spaces in the pawn rows in the new columns. The remainder of the game pieces are selected from the group consisting of a left rook (14A), right rook (14B), left knight (16A), right knight (16B), left bishop (18A), right bishop (18B), left queen (20A), right queen (20B), left king (22A), right king (22B), plurality of first left pawns (24A), and plurality of first right pawns (24B) are placed on the board in standard chess locations. The left earls (12AA) are inserted between the left knights (16A) and left bishops (18A) and the right earls (12AB) inserted between the right knights (16B) and the right bishops (18B).

The game pieces move according to the established rules of chess wherein:

The left rooks (14A) and the right rook (14B) move any number of spaces vertically or horizontally from any square. A rook cannot move past any square occupied by another game piece.

The left knight (16A) and the right knight (16B) move two squares vertically or horizontally then turning right or left and moving one additional square. The left knight (16A) and the right knight (16B) may jump intermediate game pieces.

The left bishops (18A) and the right bishops (18B) move any number of squares diagonally from any square. The bishop cannot move past any square occupied by another game piece.

The left queen (20A) and the right queen (20B) move any number of squares vertically, horizontally or diagonally from any square. The left queen (20A) and the right queen (20B) cannot move past any square occupied by another game piece.

The left king (22A)and the right king (22B) move one square vertically, horizontally, or diagonally from any square. The left king (22A) and the right king (22B) cannot move past any square occupied by another game piece.

The plurality of first left pawns (24A) and the plurality of first right pawn s (24B) move initially one or two squares forward and thereafter only one square forward. The plurality of first left pawns (24A) and the plurality of first right pawn s (24B) always move forward and capture diagonally.

Figure 2:
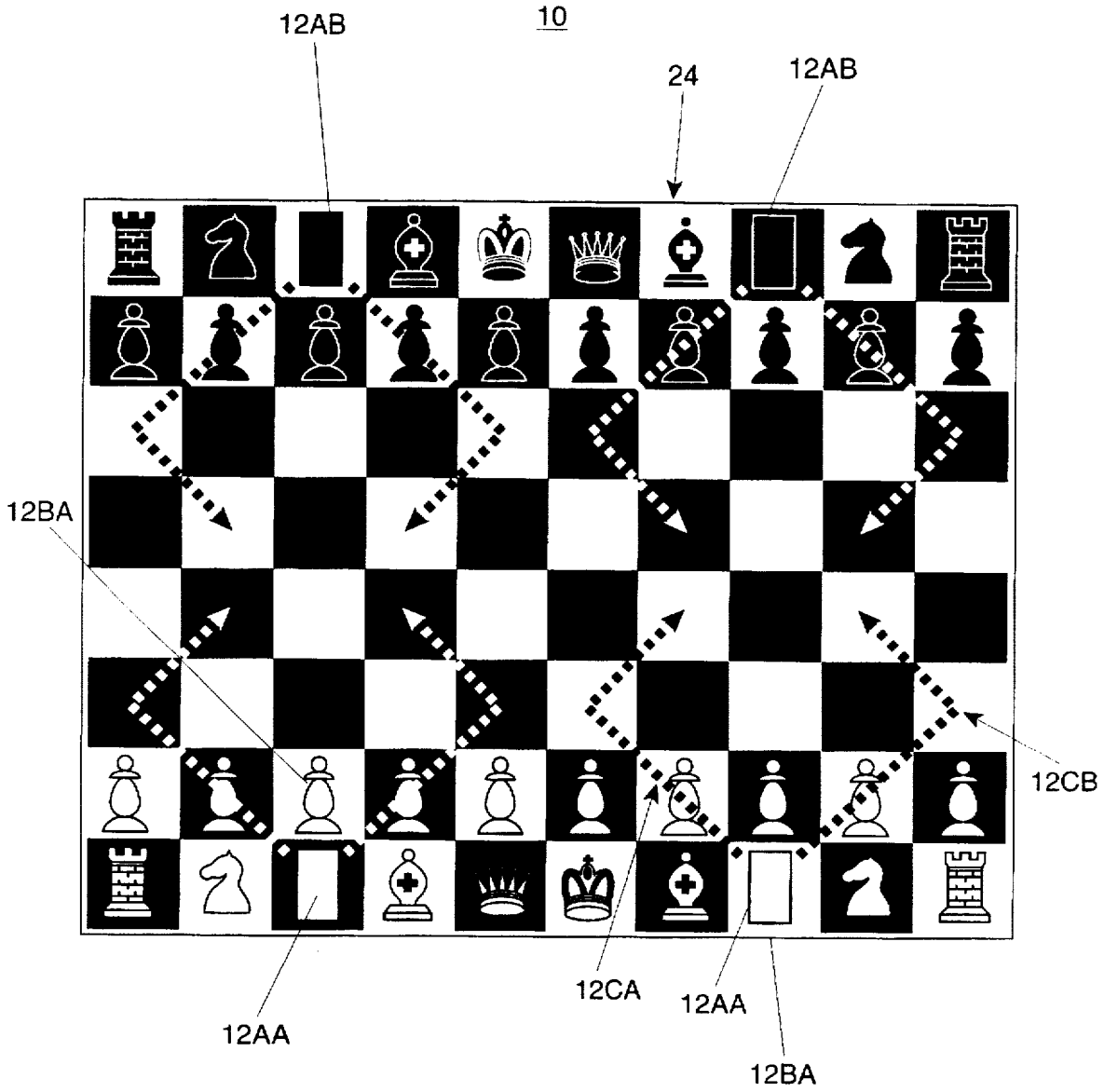
FIG. 2 is a top view of the modified chess game (10) showing the movement of the left earl and right earl.

Secondly, referring to FIG. 2 which is a top view of the modified chess game (10) showing the movement of the left earl and right earl having the following features: left earl (12AA), left earl first movement (not shown), left earl first movement first direction (not shown), left earl first movement second direction (not shown), left earl second movement (not shown), left earl second movement first direction left earl second movement second direction (not shown), left earl third movement (not shown), right earl (12AB), right earl first movement (not shown), right earl first movement first direction (not shown), right earl first movement second direction (not shown), right earl second movement (not shown), right earl second movement first direction (not shown), right earl second movement second direction (not shown), and right earl third movement (not shown).

The left earl (12AA) may be moved, from an origin, along a left earl first movement (not shown). The left earl first movement (not shown) comprises a left earl first movement first direction (not shown) along a forward diagonal for two spaces. The left earl (12AA) then moves one forward diagonal perpendicular to the left earl first movement first direction (not shown) along a left earl first movement second direction (not shown). This completes a turn for the left earl (12AA).

The left earl (12AA) as an alternative for a first move the left earl (12AA) may move along a left earl second movement (not shown). The left earl second movement (not shown) comprises a left earl second movement first direction (not shown) along a forward diagonal for one space. The left earl (12AA) then moves two forward diagonals perpendicular to a left earl second movement second direction (not shown). This completes an alternative turn for the left earl (12AA).

The left earl (12AA) captures an opponent's game piece if the opponent game piece is on a square which is the terminating square of the left earl first movement (not shown) or left earl second movement (not shown). Intervening game pieces of either side are jumped.

At the next turn for the left earl (12AA) the move sequence may be repeated. If an opponent piece is located on the next successive forward diagonal, on the next turn the left earl (12AA) may move along a left earl third movement (not shown), one forward diagonal and capture the opponent game piece.

The right earl (12AB) moves along a right earl first movement (not shown). The right earl first movement (not shown) comprises a right earl first movement first direction (not shown) along a forward diagonal for two squares the along a right earl movement second direction (not shown) perpendicular to the right earl first movement first direction (not shown) for one forward diagonal.

The right earl (12AB) as an alternative moves along a right earl second movement (not shown). The right earl second movement (not shown) comprises a right earl second movement first direction (not shown) along a forward diagonal for one space. The right earl (12AB) then moves two forward diagonals along a right earl second movement second direction (not shown).

The right earl (12AB) captures the opponent game piece if the opponent game piece is on a square which is the terminating square of the right earl first movement (not shown) or right earl second movement (not shown). Intervening pieces of either side are jumped.

At the next turn for the right earl (12AB) the move sequence may be repeated. If an opponent piece is located on the next successive forward diagonal, on the next turn the right earl (12AB) may move one forward and capture the opponent piece.

It will be understood that each of the elements described above, or two or more together, may also find an useful application in other types of constructions differing from the type described above.

While the invention has been illustrated and described as embodied in a Modified Chess Game, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of playing a modified chess game (10) consisting of the steps of:

A) using a game board (26) by a first player and a second player, the game board (26) consisting of only eight horizontal rows and only ten vertical columns having mutual intersections therebetween defining alternating colored squares of play;

B) alternating turns by the first player and a second player;

C) using a first set of game pieces by the first player, the first set of game pieces having an identification means;

C) arrranging the first set of game pieces on a side of the game board (26) proximal to the first player D) positioning initially the first set of game pieces consists of ten first left pawns (24A) on a second proximal row having one left pawn (24A) per square;

E) positioning initially a left rook (14A) on a left proximal square in the first proximal row and first proximal column;

F) positioning initially a left knight (16A) is on a proximal square in the first proximal row adjacent the left rook (14A);

G) positioning a left earl (12AA) is on a proximal square in the first proximal row adjacent the left knight (16A);

H) positioning a left bishop (18A) is on a first right proximal square adjacent the left earl (12AA);

I) positioning a left queen (20A) is on a proximal square in the first proximal row adjacent the left bishop (18A);

J) positioning a left king (22A) on a proximal square in the first proximal row adjacent the left queen (20A)

K) positioning a second left bishop (18A) is on a proximal square in the first proximal row adjacent the left king (22A);

KL) positioning a second left earl (12AA) is on a proximal square in the first proximal row adjacent the second left bishop;

L) positioning a second left knight (16A) is on a proximal square in the first proximal row the second left earl (12AA);

M) positioning a second left rook (14A) is initially positioned on a proximal square in the first proximal row adjacent the second left knight (16A);

N) using the first set of game pieces consisting one of the following steps selected from a group consisting of:

i) moving the left rook (14A) from an initial square a number of spaces vertically or horizontally to a secondary square, ii) capturing an opponent's piece if located in the secondary square, iii) moving the left knight (16A) from an initial square two squares vertically or horizontally then perpendicularly one additional square to a secondary square, iv) jumping intermediate game pieces if present by the left knight (16A), v) capturing an opponent piece if located in the secondary square, vi) moving the left bishop (18A) a number of squares diagonally from an initial square to a secondary square, vii) capturing an opponent's piece if located in the secondary square, viii) moving the left queen (20A) any number of squares vertically or horizontally or diagonally from an initial square to a secondary square, ix) capturing and opponent piece if located in the secondary square, x) moving the left king (22A) one square vertically or horizontally or diagonally from an initial square to a secondary square, xi) capturing an opponent's piece if located on the secondary square, xii) moving the left pawn (24A) from an initial square to a secondary square in a move selected from a group consisting of the initial square one square forward to the secondary square and from an initial square two squares forward to a secondary square, xiii) capturing an opponent's piece if located in the secondary square squares diagonally from the path of the first left pawn (24A), xiv) movement of the left earl consisting of only moving the left earl (12AA) along a left earl first movement direction which comprises a left earl first movement first direction from an initial square along a forward diagonal for two squares, xv) jumping intermediate game pieces therebetween to a secondary square then moving the left earl (12AA) from the secondary square one square perpendicular to the left earl first movement first direction along a left earl first movement second direction, xvi) jumping intermediate game pieces therebetween by the left earl (12AA) to a tertiary square, xvii) capturing an opponent's game piece if located on the tertiary square, O) using a second set of game pieces by the second player, the second set of game pieces having an identification means differing from the identification means of the first set of game pieces;

P) arranging the second set of game pieces on a side of the game board (26) proximal to the second player, Q) positioning ten right pawns (24B) on a second proximal row having one right pawn (24B) per square;

R) positioning a right rook (14B) on a left proximal square in the first proximal row and first proximal column;

S) positioning a right knight (16B) on a proximal square in the first proximal row adjacent the right rook (14B);

T) positioning a right earl (12AB) on a proximal square in the first proximal row adjacent the right knight (16B);

U) positioning a right bishop (18B) on a proximal square in the first proximal row adjacent the right earl (12AB);

V) positioning a right queen (20B) on a proximal square in the first proximal row adjacent the right bishop (18B);

W) positioning a right king (22B) on a proximal square in the first proximal row adjacent the right queen (20B);

X) positioning a right bishop (18B) on a proximal square in the first proximal row adjacent the right king (22B);

Y) positioning a second right earl (12AB) on a proximal square in the first proximal row adjacent the right bishop (18B);

Z) positioning a second right knight (16B) on a proximal square in the first proximal row adjacent the second right earl (12AB);

AA) positioning a right rook (14B) on a proximal square in the first proximal row adjacent to the second right knight (16B);

AB) using the second set of game pieces consisting one of the following steps selected from a group consisting of:

i) moving the right rook (14B) from an initial square a number of spaces vertically or horizontally to a secondary square ii) capturing an opponent's piece if located in the secondary square, iii) moving the right knight (16B) from an initial square two squares vertically or horizontally then perpendicularly one additional square to a secondary square, iv) jumping intermediate game pieces if present by the right knight (16B), v) capturing an opponent piece if located in the secondary square, vi) moving the right bishop (18B) a number of squares diagonally from an initial square to a secondary square, vii) capturing an opponent's piece if located in the secondary square, viii) moving the right queen (20B) any number of squares vertically or horizontally or diagonally from an initial square to a secondary square, ix) capturing and opponent piece if located in the secondary square, x) moving the right king (22B) one square vertically or horizontally or diagonally from an initial square to a secondary square, xi) capturing an opponent's piece if located on the secondary square, xii) moving the right pawn (24B) from an initial square to a secondary square in a move selected from a group consisting of the initial square one square forward to the secondary square and from an initial square two squares forward to a secondary square, xiii) capturing an opponent's piece if located in the secondary square squares diagonally from the path of the right pawn (24B), xiv) movement of the right earl consisting of only moving the right earl (12AB) along a right earl first movement direction which comprises a right earl first movement first direction from an initial square along a forward diagonal for two squares, xv) jumping intermediate game pieces therebetween to a secondary square then moving the right earl (12AB) from the secondary square one square perpendicular to the right earl first movement first direction along a right earl first movement second direction jumping intermediate game pieces therebetween by the right earl (12AB) to a tertiary square, capturing an opponent's game piece if located on the tertiary square; and AC) alternating turns between the first player and the second player wherein the first player and the second player move in turn one of the game pieces according to the game piece moving ability.

2. The method of playing a modified chess game (10) as described in claim 1, wherein the squares of play are defined by contrasting colors.

3. The method of playing a modified chess game (10) as described in claim 1, wherein the identification means is a contrasting color.

4. The method of playing a modified chess game (10) as described in claim 1, wherein an additional step consists of capturing an opponent game piece by the left earl (12AA) on the next turn moving along a left earl third movement one forward diagonal.

5. The method of playing a modified chess game (10) as described in claim 1, wherein an additional step consists of capturing an opponent game piece by the right earl (12AB) on the next turn moving along a right earl third movement one forward diagonal.

* * * * *